US009594326B2

(12) United States Patent
Ofir et al.

(10) Patent No.: US 9,594,326 B2
(45) Date of Patent: Mar. 14, 2017

(54) PHOTOCONDUCTIVE LAYER REFRESH

(71) Applicant: Hewlett-Packard Indigo, B.V., Amstelveen (NL)

(72) Inventors: Amir Ofir, Amstelveen (NL); Sasi Moalem, Amstelveen (NL); Dmitry Maister, Amstelveen (NL); Seongsik Chang, Palo Alto, CA (US)

(73) Assignee: HEWLETT-PACKARD INDIGO, B.V., Amstelveen (NL)

( * ) Notice: Subject to any disclaimer, the term of this patent is extended or adjusted under 35 U.S.C. 154(b) by 0 days.

(21) Appl. No.: 14/901,402

(22) PCT Filed: Jun. 28, 2013

(86) PCT No.: PCT/EP2013/063706
§ 371 (c)(1),
(2) Date: Dec. 28, 2015

(87) PCT Pub. No.: WO2014/206497
PCT Pub. Date: Dec. 31, 2014

(65) Prior Publication Data
US 2016/0147168 A1 May 26, 2016

(51) Int. Cl.
*G03G 21/00* (2006.01)
*G03G 15/02* (2006.01)

(52) U.S. Cl.
CPC ..... *G03G 15/0275* (2013.01); *G03G 15/0266* (2013.01); *G03G 21/0094* (2013.01)

(58) Field of Classification Search
USPC ..... 399/128, 129
See application file for complete search history.

(56) References Cited

U.S. PATENT DOCUMENTS

| | | | | |
|---|---|---|---|---|
| 2,741,959 A | | 4/1956 | Rheinfrank et al. | |
| 4,362,797 A | | 12/1982 | Shimizu | |
| 4,461,563 A | | 7/1984 | Favata | |
| 4,623,243 A | * | 11/1986 | Iijima | G03G 21/06 399/128 |
| 5,247,328 A | | 9/1993 | Daunton et al. | |

(Continued)

FOREIGN PATENT DOCUMENTS

| | | |
|---|---|---|
| GB | 1297925 | 11/1972 |
| JP | S 5786838 | 5/1982 |

(Continued)

OTHER PUBLICATIONS

Yamazoe M., "Magnetic Recording Media Photoconductors", vol. 55; Issue 1: Feb. 20, 2009 <http://www.fujielectric.com/company/tech/pdf/55-01/FER-55-1-000-2009.pdf>.

(Continued)

*Primary Examiner* — Hoan Tran
(74) *Attorney, Agent, or Firm* — HP Inc. Patent Department

(57) ABSTRACT

In one implementation, an image forming apparatus may include a photoconductive unit and a refresh unit. The photoconductive unit may include a photoconductive layer. The photoconductive layer may have a first polarity during a print routine. The refresh unit may apply a voltage to the photoconductive layer to electrically bias the photoconductive layer to have a second polarity during a refresh routine.

14 Claims, 5 Drawing Sheets

(56) References Cited

U.S. PATENT DOCUMENTS

| | | | | |
|---|---|---|---|---|
| 6,223,011 | B1 | 4/2001 | Abramsohn et al. | |
| 7,155,152 | B2 * | 12/2006 | Iwai ..... | G03G 15/1645 399/128 |
| 8,050,581 | B2 | 11/2011 | Chang et al. | |
| 8,891,985 | B2 * | 11/2014 | Tanaka ..... | G03G 15/0283 399/44 |
| 2006/0082823 | A1 | 4/2006 | Ahn | |
| 2011/0286752 | A1 | 11/2011 | Burry et al. | |

FOREIGN PATENT DOCUMENTS

| | | |
|---|---|---|
| JP | S 58118684 | 7/1983 |
| JP | 2012185308 A | 9/2012 |

OTHER PUBLICATIONS

International Search Report and Written Opinion dated Apr. 3, 2014, PCT Patent Application No. PCT/EP2013/063706 dated Jun. 28, 2013 (ISA/EP).

* cited by examiner

PHOTOCONDUCTIVE LAYER REFRESH

BACKGROUND

Electrophotography is commonly used in digital printers or presses. Digital printing may use a variety of print material to reproduce a variety of digital sources on a variety of media. Digital printers or presses may utilize a photoconductor to apply print material to a print medium. The photoconductor may be charged and exposed to light. Charged print material, such as toner, may be attracted to areas of the photoconductor. The print material may be transferred from the photoconductor to the print medium directly or to an offset unit. Heat and/or pressure may fuse the toner to the medium.

DETAILED DESCRIPTION

In the following description and figures, some example implementations of an image forming apparatus, systems, and/or methods are described. An image forming apparatus using electrophotography may have a constant or intermittent charge on a photoconductor during a print routine, or print cycle. After completing a number of print cycles over a time period, the photoconductor may obtain characteristics, or polarization effects, that may decrease print quality. For example, the photoconductor may become ionized, change in molecular structure, may trap charges, or may show signs of lateral conductivity. These contamination effects, including polarization effects, may make it difficult to accurately affix print material to a print article or medium. The print medium may include an intermediate transfer member. Print quality may be improved by maintaining the photoconductor with a routine that may lessen an effect of contamination.

Various examples described below were developed to lessen the effects of biasing a photoconductor to one polarity. By scheduling time to refresh the photoconductor by charging the photoconductive layer of the photoconductive unit to a polarity opposite of the polarity of the photoconductive layer during a print cycle, the effects of polarization from charging in one polarity may be diminished.

Figure 1:
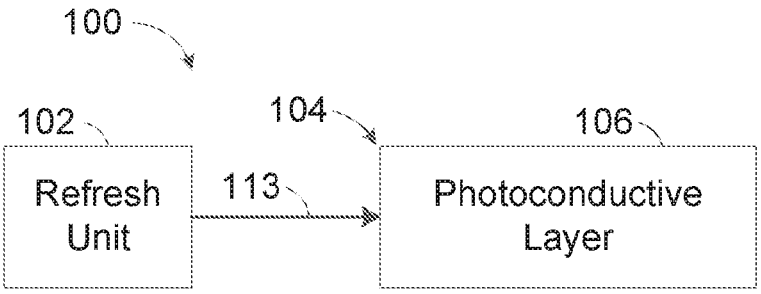
FIGS. 1 and 2 are block diagrams of examples of image forming apparatus.
Figure 2:
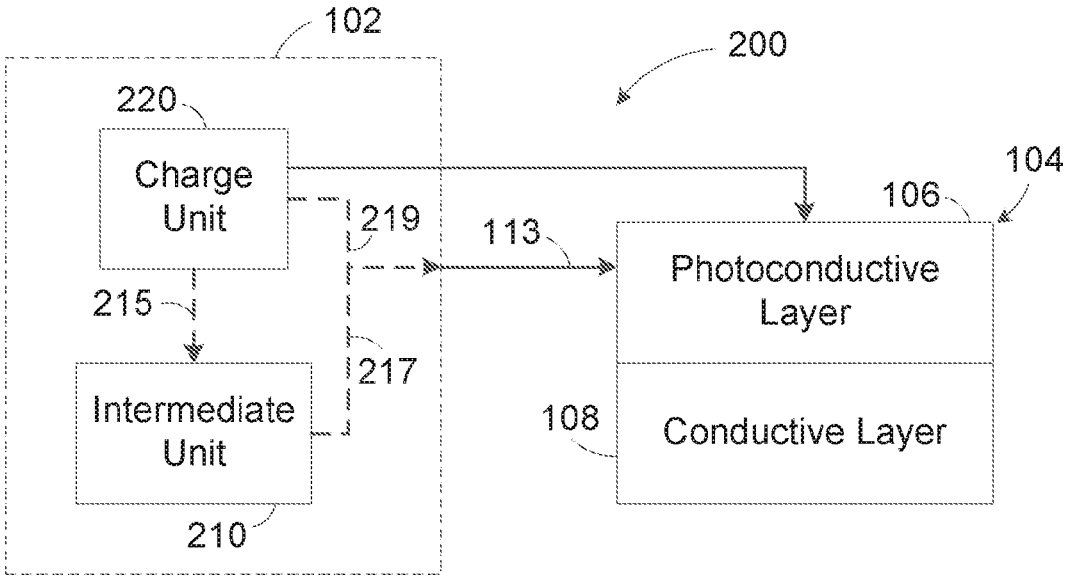

FIGS. 1 and 2 are block diagrams of examples of image forming apparatus. Referring to FIG. 1, an example image forming apparatus 100 may include a refresh unit 102 and a photoconductive unit 104.

In general, the photoconductive unit 104 may include a photoconductive layer 106. For example, the photoconductive unit 104 may be an organic photoconductor. The photoconductive layer 106 may be configured to apply a print material to a print article. The print material may be directly applied to the print article or indirectly applied by using an offset unit, or an intermediate transfer member, for transferring the print material. An offset unit may be any intermediate transfer member capable of transferring the print material from the photoconductive unit 104 to the print article. The photoconductive layer 106 may be capable of being electrically biased to have a first polarity during a print routine. The photoconductive layer 106 may be capable of being electrically biased to have a second polarity during a refresh routine. The refresh routine may be a non-print routine to occur when the image forming apparatus 100 is not in a print mode. The image forming apparatus 100 may be operable in either a refresh mode or a print mode.

The refresh unit 102 may be configured to apply a voltage 113 to the photoconductive layer 106 of the photoconductive unit 104 to electrically bias the photoconductive layer 106 to have a second polarity during the refresh routine. The voltage 113 may polarize the photoconductive layer 106 to a polarity that is opposite of the polarity of the photoconductive layer 106 during a print routine. For example, the first polarity may be negative and the second polarity may be positive. The voltage may be supplied by direct current ("DC"), alternating current ("AC"), pulsating current, variable current, or a combination of currents capable of polarizing the photoconductive layer 106. "Voltage," such as voltage 113, may be discussed as a "refresh voltage," or in conjunction with another modifier to denote the source of the voltage, but may otherwise have the same characteristics of other voltages described herein.

The voltage 113 may achieve an avalanche threshold. The avalanche threshold may represent the strength of the electric field, or potential gradient, to form a conductive region around the conductor. In particular, the avalanche threshold may be based on a function defining a point at which the gas or fluid around the conductor ionizes to form an electron avalanche. The gas or fluid around the conductor may be air.

One example of a charge that may produce an electron avalanche is a corona charge. A corona charge may have an electric field with the strength sufficient to ionize a neutral atom where the energy of electric field may accelerate oppositely charged particles in opposite directions at a velocity high enough to collide with and ionize another atom. This may repeat until a certain distance is reached where the electric field strength may be low enough to no longer provide sufficient energy to continue ionizing more atoms.

The avalanche threshold may be based on the distance between two surfaces, or gap length. For example, the avalanche threshold may be determined based on a function of an electric field strength and a gap length between the photoconductive layer and a charge surface; the charge surface may be part of charge mechanism that may apply the refresh voltage to the photoconductive layer. The electric field may become low enough at a distance from the conductor that the electric field may not provide enough energy to ionize the air at that distance. For example, a 1000 volt charge may achieve the avalanche threshold in air over a gap length of 1 mm, but may not achieve the avalanche threshold in air over a gap length of 10 cm.

A voltage at or above the threshold based on the gap length may lessen the effect of polarization and/or contamination on the photoconductive layer 106. For example, if an avalanche threshold is 600 volts, the avalanche threshold may be achieved by meeting the threshold by applying 600 volts or by surpassing the threshold by applying more than 600 volts. The avalanche threshold may be based on corona charging, Paschen's law, or other studies or experiments providing a minimum voltage to apply between two surfaces to form an electron avalanche.

Referring to FIG. 2, an example image forming apparatus 200 may include a refresh unit 102 and a photoconductive unit 104. The refresh unit 102 may include at least one of a charge unit 220 and an intermediate unit 210. The photoconductor unit 104 may include a photoconductive layer 106 and a conductive layer 108. The photoconductive layer 106 may be capable of being electrically biased to have a first polarity during a print routine.

The charge unit 220 may be operatively coupled to the photoconductive unit 104. The charge unit 220 may charge the photoconductive layer 106 to a print polarity during a print routine while the image forming apparatus 200 is in a print mode. The refresh unit 102 may charge the photoconductive layer 106 to a refresh polarity during a refresh routine while the image forming apparatus 200 is in a refresh mode. The refresh polarity may be opposite of the print polarity.

Figure 4:
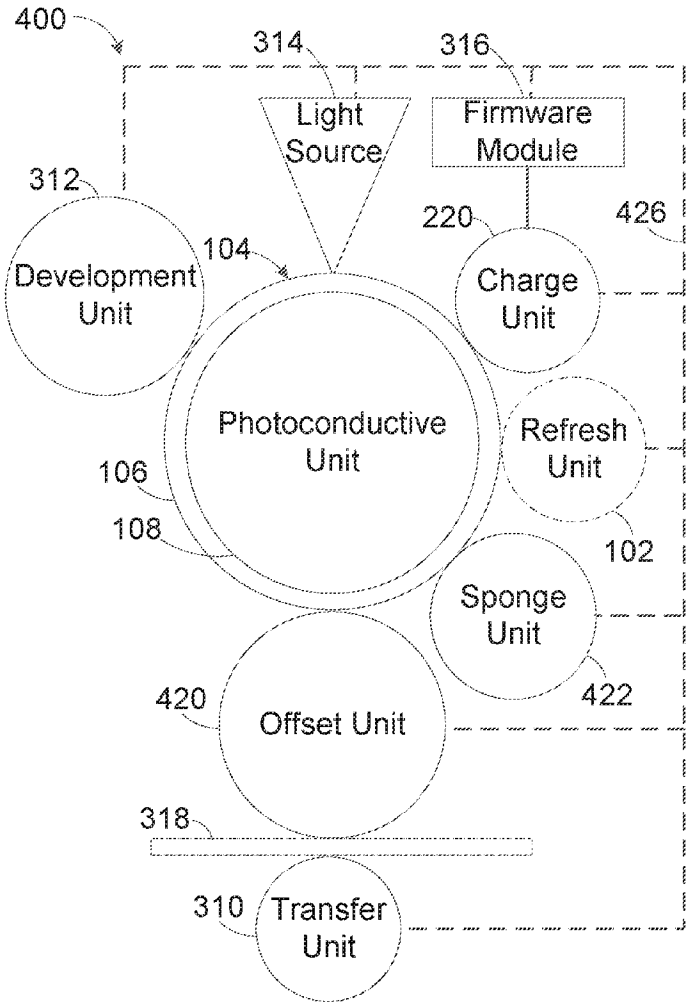
FIGS. 3 and 4 depict components for implementing various examples.

The refresh unit 102 may be operatively coupled to the photoconductive unit 104. The refresh unit 102 may include a charge mechanism to electrically bias the photoconductive layer 106 of the photoconductive unit 104 to have a polarity opposite of the print polarity. The refresh unit 102 may be a unit dedicated to providing a charge to the photoconductive layer 106 during the refresh routine or may include at least one of the charge unit 220 and/or the intermediate unit 210. For example, the refresh unit 102 may be the charge unit 220 and the charge unit 220 may be capable of both charging the photoconductive layer 106 to a negative polarity during the print routine and charging the photoconductive layer 106 to a positive polarity during the refresh routine. The intermediate unit 210 may be any chargeable component of an image forming apparatus capable of transferring a charge to the photoconductive layer 106 to electrically bias the photoconductive layer 106 to have a polarity opposite the polarity of the photoconductive layer 106 during the print routine. For example, FIG. 4 shows a development unit 312, a transfer unit 310, an offset unit 420, a sponge unit 422, and the conductive layer 108 of the photoconductive unit 104 and the intermediate unit 210 may be at least one of a development unit 312, a transfer unit 310, and offset unit 420, a sponge unit 422, and the conductive layer 108 of the photoconductive unit 104.

The charge unit 220 may be configured to apply a voltage 113 to the photoconductive layer 106 of the photoconductive unit 104. The voltage 113 may electrically bias the photoconductive layer 106 to have a polarity opposite the polarity of the photoconductive layer 106 during a print routine. The voltage 113 may achieve an avalanche threshold. The charge unit 220 may apply the voltage 113 during a refresh routine.

The intermediate unit 210 may be operatively coupled to the photoconductive unit 104 and may be configured to apply the voltage 113 to the photoconductive layer 106 of the photoconductive unit 104. The intermediate unit 210 may be charged to electrically bias the photoconductive layer 106 to a polarity opposite the polarity of the photoconductive layer 106 during a print routine by applying the voltage 113 to the photoconductive layer 106 during the refresh routine. The voltage 113 may achieve an avalanche threshold. The intermediate unit 210 may or may not have a charge during the print routine. For example, the charge unit 220 may charge the intermediate unit 210 using a voltage 215 to allow the intermediate unit 210 to apply the voltage 113 to the photoconductive layer 106.

The refresh unit 102 may consist of a plurality of components capable of providing a refresh charge to the photoconductive layer 106. For example in FIG. 2, a refresh unit 102 may include a charge unit 220 and an intermediate unit 210. Each one of the plurality of components may provide a charge to the photoconductive layer 106 and the charges of the plurality of components may aggregate to the refresh voltage 113 to electrically bias the photoconductive layer 106 to have a polarity opposite of the polarity of the photoconductive layer 106 during a print routine. For example during an example refresh routine, the charge unit 220 may apply a charge 219 to the photoconductive layer 106 and the intermediate unit 210 may apply a charge 217 to the photoconductive layer 106. The combination of the charges 217 and 219 may have voltages that aggregate to be the refresh voltage 113 and the aggregate voltage may achieve the avalanche threshold. The charges 217 and 219 may both achieve the avalanche threshold, one of the charges 217 and 219 may achieve the avalanche threshold, or neither charge 217 nor charge 219 may achieve the avalanche threshold alone, but may achieve the avalanche threshold together. For example, if the avalanche threshold is 1100 volts, the intermediate unit 210 may provide a charge 217 of 600 volts and the charge unit 220 may provide a charge 219 of 600 volts so that the total refresh voltage 113 combines to be 1200 volts, which surpasses the avalanche threshold.

Figure 3:
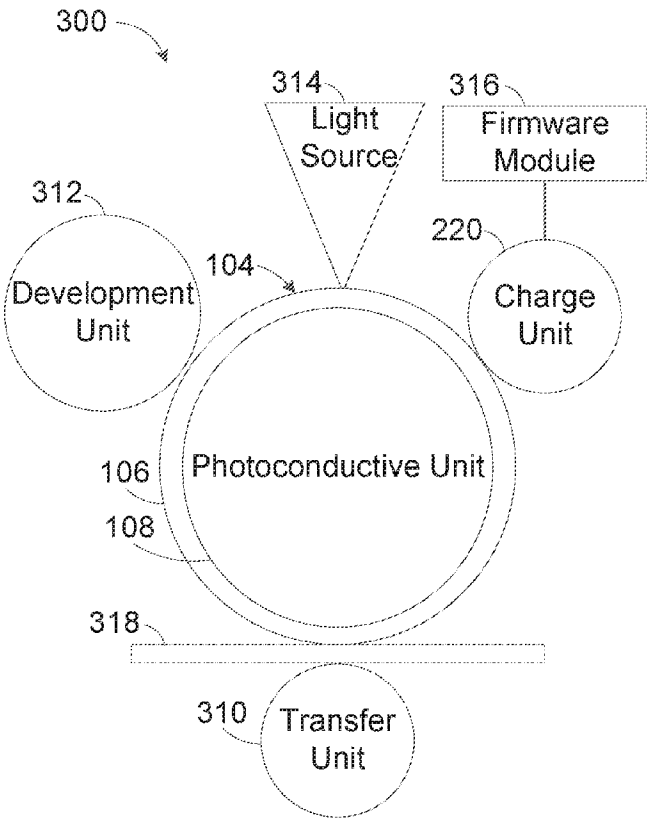

FIGS. 3 and 4 depict components for implementing various embodiments. Referring to FIG. 3, an example image forming apparatus 300 may generally comprise a charge unit 220, a photoconductive unit 104, a transfer unit 310, a development unit 312, and a light source 314. The photoconductive unit 104 may include a photoconductive layer 106 and a conductive layer 108.

During a print routine, the charge unit 220 may charge the photoconductive layer 106. The conductive layer 108 may have a polarity in relation to the charge on the photoconductive layer or may be grounded. The charge unit 220 may apply a print voltage to electrically bias the photoconductive layer 106 to have a print polarity during the print routine. For example, the charge unit 220 may use a corona charge to ionize the air between the charge unit 220 and the photoconductive unit 104 to repel electrons to the photoconductive layer 106. The photoconductive layer 104 may act as an isolator due to the charge. The light source 314 may apply light to the photoconductive layer 106 to make a portion of the photoconductive layer 106 conductive. The conductive portion of the photoconductive layer 106 may not be charged and may not attract print material. The development unit 312 may apply a print material, such as toner, to the charged areas of the photoconductive layer 106. The photoconductive layer 106 may apply a print material from the development unit 312 to a print article 318 using the transfer unit 310. The print voltage may be the voltage used by the photoconductive layer 106 during a print routine to maintain operability for printing.

One or more print routines may cause the photoconductive layer 106 to be contaminated. Contamination may affect the photoconductive layer 106 to be conductive when the desired effect of photoconductive layer 106 may be to act as an isolator. Contamination may be any polarization effect, including lateral conductivity, ionization, ion migration, a molecular structure change, an electron trap, or a polarized contaminant particle being attracted to the photoconductive layer 106. The effects of contamination on the printed image may include streaking, scratching, blurring, and/or other detriments to print quality.

A refresh routine may be scheduled to temper, dull, deaden, reverse, curtail, screen, or otherwise lessen the effects of contamination and/or polarization. The refresh routine may be scheduled before a print routine, while a print routine is paused, or after a print routine is completed. The refresh routine may be scheduled based on at least one of a time elapsed, a print cycle amount, and a level of contamination. A print cycle amount may include one or more print routines. A level of contamination may be based on a tolerance setting in comparing a print article to the original image or detecting an amount of contamination above a contamination threshold.

A refresh unit may execute opposite polarity charging on the photoconductive layer during a refresh routine when the image forming apparatus 300 is in a refresh mode. In one example as described in relation to FIG. 3, the refresh unit may be the charge unit 220 configured to charge the photoconductive layer 106 to both positive and negative polarities depending on what mode the image forming apparatus 300 is operating and/or which routine is being executed.

A firmware module 316 may be in communication with the component designated to charge the photoconductive layer 106 to schedule a refresh routine, set a time period to execute the refresh routine, and set a level of the voltage applied by the designated component, such as the charge unit 220 in FIG. 3. A firmware module 316 may comprise any combination of physical and logical components, such as circuitry and instructions on memory, to manage operations of the image forming apparatus 300 designated to the firmware module 316. The firmware module 316 may communicate to the charge unit 220 to switch charging polarities depending on the operation mode and/or the routine performed. The firmware module 316 may designate which component may charge the photoconductive layer 306.

During a refresh routine, the component designated by the firmware to charge the photoconductive layer 106, such as the charge unit 220 in FIG. 3, may apply a refresh voltage to charge the photoconductive layer 106 of the photoconductive unit 104. The refresh voltage may electrically bias the photoconductive layer 106 to have a refresh polarity opposite of the print polarity. For example, the print polarity may be negative and the refresh polarity may be positive. The refresh voltage may achieve an avalanche threshold by applying a voltage equivalent to the avalanche to the photoconductive layer 106 or applying a voltage exceeding the avalanche to the photoconductive layer 106.

Referring to FIG. 4, an example image forming apparatus 400 may generally comprise a charge unit 220, a photoconductive unit 104, a transfer unit 310, a development unit 312, a light source 314, a firmware module 316, an offset unit 420, and a sponge unit 422. The image forming apparatus 400 may also include a refresh unit 102. The photoconductive unit 104 may include a photoconductive layer 106 and a conductive layer 108. The image forming apparatus 400 may be operable in a print mode and a refresh mode. The image forming apparatus 400 may perform a print routine in a print mode, switch to a refresh mode, perform a refresh routine, and switch back to a print mode.

During a print routine, the charge unit 220 may charge the photoconductive layer 106. The charge unit 220 may apply a print voltage to electrically bias the photoconductive layer 104 to have a polarity during the print routine. For example, the charge unit 220 may be operatively coupled to the photoconductive unit 104 to apply a voltage to the photoconductive layer 106 to charge the photoconductive layer 106 to a polarity during a print routine, such as a negative polarity. The light source 314 may neutralize areas of the photoconductive layer 106 and the charged areas of the photoconductive layer 106 may attract toner from the development unit 312. The sponge unit 422 may apply a dampening solution to the photoconductive layer 106 or may otherwise utilize a substrate to clean the photoconductive layer 106. The offset unit 420 may receive the toner from the photoconductive layer 106 and apply the toner to a print article 318 using the transfer unit 310.

A refresh unit 102 may be operatively coupled to the photoconductive unit 104 to apply a refresh voltage to the photoconductive layer 106 to charge the photoconductive layer 106 to a positive polarity during a refresh routine. The refresh voltage may achieve an avalanche threshold based on the gas inside the image forming apparatus 400 and the gap length between the photoconductive layer 106 and the refresh unit 102. The gas within the image forming apparatus 400 may be air.

Alternatively, the image forming apparatus 400 may use one or more of the other components to operate as the refresh unit 102. For example, the refresh unit 102 may be at least one of the charge unit 220, the offset unit 420, the development unit 312, the sponge unit 422, the conductive layer 108 of the photoconductive unit 104, or any other unit that is operatively coupled to the photoconductive unit 104 to charge the photoconductive layer 106. The components of the image forming apparatus 400 may be electrically coupled over an electrical connection 426 to provide a charge from one component to another. The electrical connection 426 may provide a degree of electrical coupling between a component providing a charge and the component receiving a charge.

The refresh voltage may be a combination of voltage from one or more of the components of the image forming apparatus 400 that are coupled to the photoconductive unit 104 to charge the photoconductive layer 106 to an opposite print polarity, such as a positive polarity, during a refresh routine. For example during the refresh routine, the offset unit 420 may be operatively coupled to the photoconductive unit 104 to charge the photoconductive layer 106 with an offset unit charge, or a charge from the offset unit, where the offset unit voltage of the offset unit charge may meet or exceed an avalanche threshold and may charge the photoconductive layer 106 to a positive polarity. For another example during the refresh routine, the charge unit 220 and the offset unit 420 may be operatively coupled to the photoconductive unit 104 to charge the photoconductive layer 106; the charge unit 220 may apply a charge unit voltage and the offset unit 420 may apply an offset unit voltage where the combination of the charge unit voltage and the offset unit voltage may achieve the avalanche threshold. In that example, the charge unit voltage or the offset unit voltage alone may not achieve the avalanche threshold, but the combination of voltage may achieve the avalanche threshold. Generally, the combination of voltage may include one voltage and/or charge from a single unit. The terms of "charge unit voltage" and "offset unit voltage" are used to distinguish the source of the voltage, but the voltages may not otherwise be different.

Figure 5:
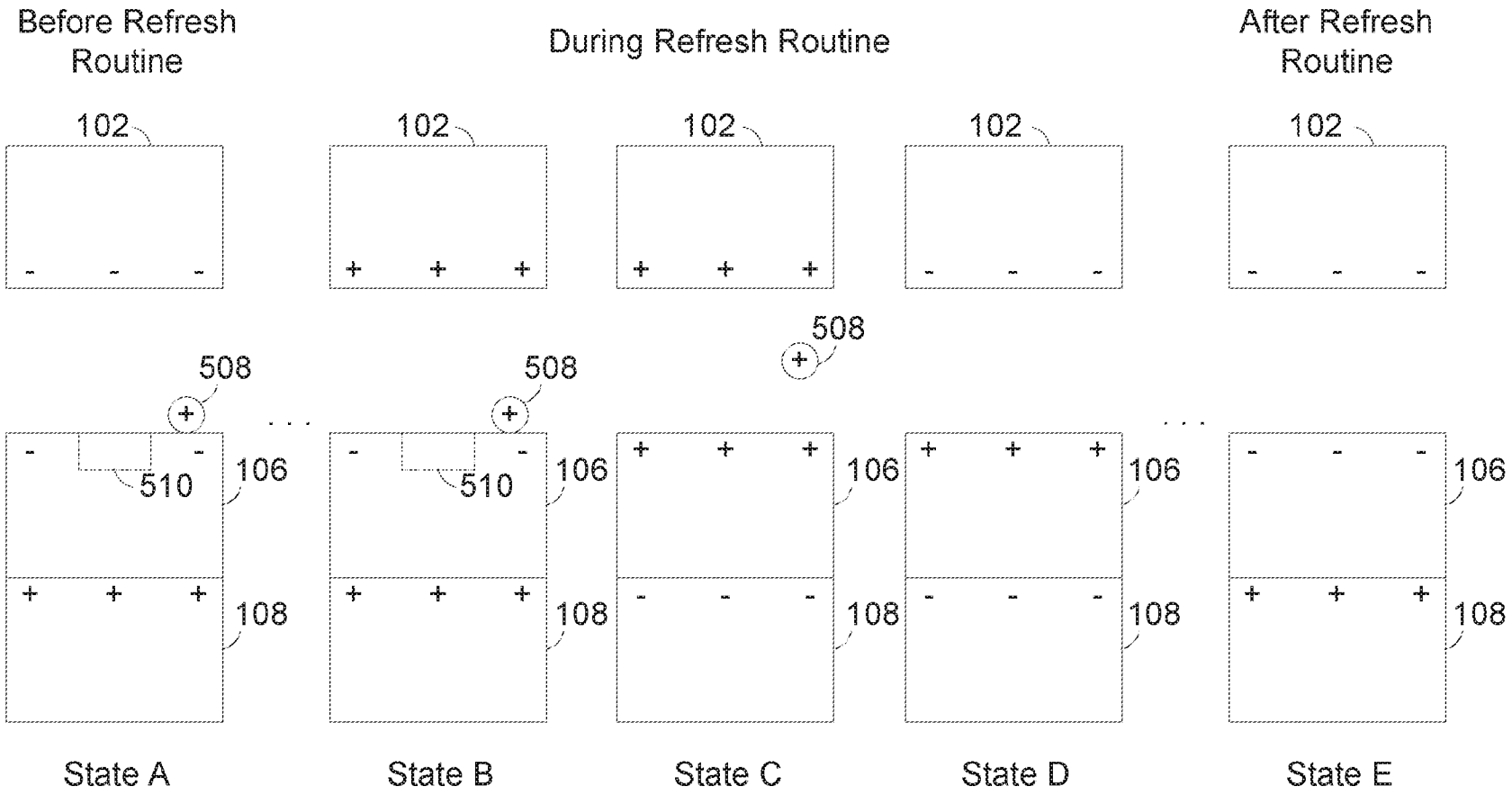
FIGS. 5 and 6 depict states during example operations of various implementations of an image forming apparatus.
Figure 6:
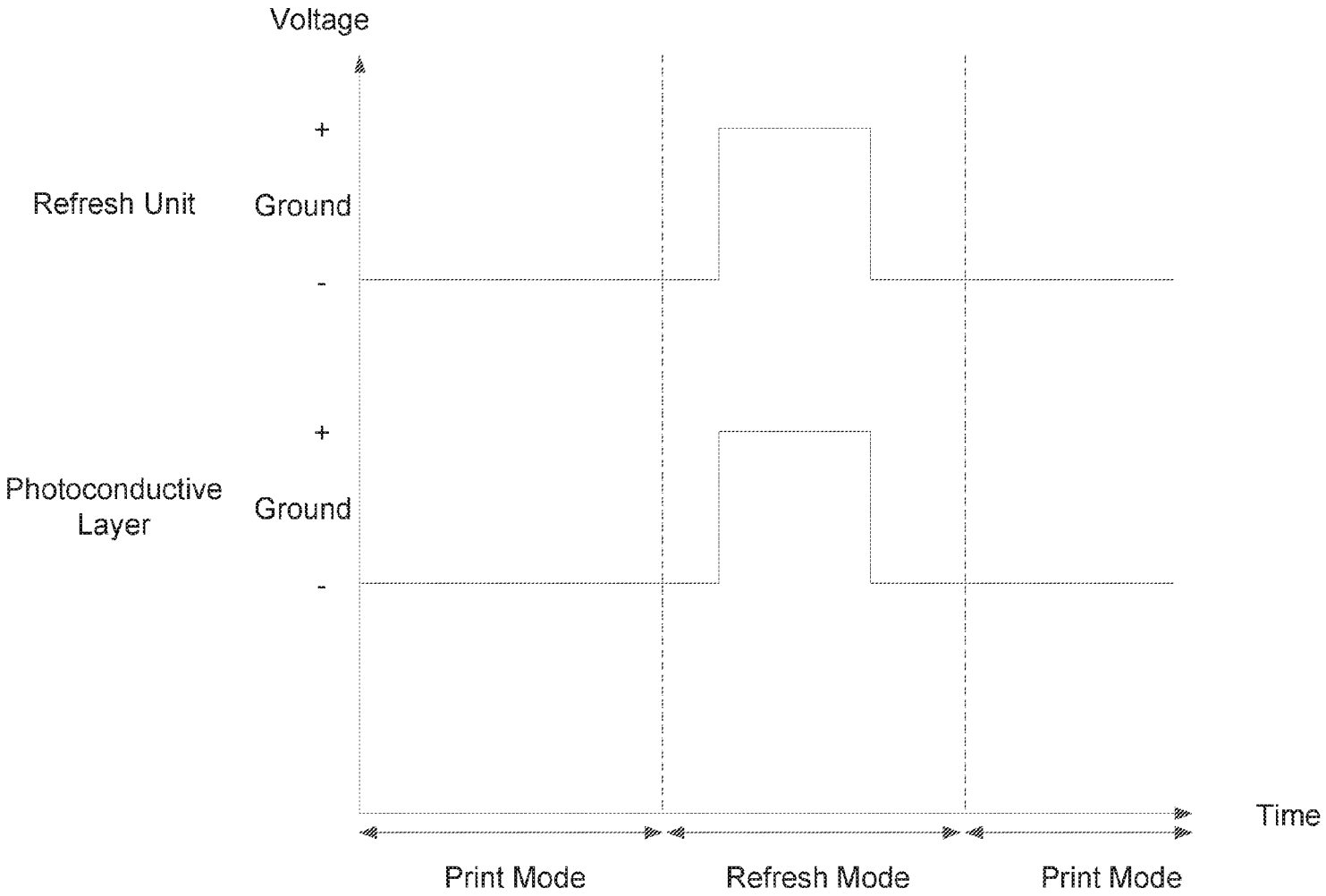

FIGS. 5 and 6 depict states during example operations of various implementations of an image forming apparatus. In particular, FIG. 5 provides examples of operation states of the refresh unit 102, the photoconductive layer 106, and the conductive layer 108 before, during, and after a refresh routine and FIG. 6 depicts an example voltage transition of the charge unit and the photoconductive layer during a refresh routine between two print routines.

Referring to FIGS. 5 and 6, the components of the image forming apparatus may be in state of operation having a particular polarity at any given time in a print mode or refresh mode. For example, the polarity of the photoconductive layer 106 may be negative prior to execution of a refresh routine in a refresh mode in conjunction with the print voltage provided by the charge unit during a print routine. The conductive layer 108 may be polarized or may be grounded in accordance with the requirements of the print routine. The photoconductive layer 106 may be affected by contamination prior to execution of a refresh routine. For example, the photoconductive layer 106 may be affected by lateral conductivity 510 and may have a polarized particle 508 attracted to the photoconductive layer 106 as shown as state A in FIG. 5.

In an example state, such as state B, the image forming apparatus may switch to a refresh mode and initiate a refresh routine. The refresh unit 102 may charge to a state having a polarity opposite the polarity of the photoconductive layer 106 during the print routine. For example, if the photoconductive layer 106 is charged negatively during the print routine, the refresh unit 102 may prepare to charge the photoconductive layer 106 to have a positive polarity during the refresh routine. The voltage of the refresh unit 102 may change in accordance with this preparation. For example, as shown in FIG. 6, the refresh unit 102 may switch to producing a positive polarity during a refresh mode if the photoconductive layer 106 is charged negatively during print mode.

In an example state during the refresh mode, such as state C, the refresh unit 102 may charge the photoconductive layer 106 to a polarity opposite the polarity of the photoconductive layer 106 during the print routine. The refresh unit 102 may charge the photoconductive layer 106 by ionizing the air between the refresh unit 102 and the photoconductive layer 106. The effects of charging the photoconductive layer 106 to a particular polarity during the print routine may be diminished, screened, or removed by changing the electrical bias of the photoconductive layer 106 to charge the photoconductive layer 106 opposite to the polarity during the print routine. For example in state C of FIG. 5, the polarized particle 508 may be repelled by the change in polarity and the lateral conductivity may be removed by the change in polarity. The refresh unit 502 may charge the photoconductive layer 106 for a designated amount of time based on the level of contamination, a time period elapsed, and/or the amount of consecutive print cycles since the last refresh routine. The designated amount of time may be less than a damage threshold to avoid adversely affecting the condition of the photoconductive layer 106 based on the material and/or condition of the photoconductive layer 106.

In another example refresh routine state, such as state D, the refresh unit 102 may change voltage and polarity in preparation for a print routine. For example, the refresh unit 102 may neutralize or begin charging in a polarity used during the print routine, such as a negative polarity. The photoconductive layer 106 may continue to be charged to the opposite polarity, such as in state D; may be neutralized; or may be charged to the print polarity in preparation for a print routine; such as in state E. The diminishing, screening, or removal of the contamination may refresh the photoconductive layer 106 to produce an improved print quality in comparison to before the execution of the refresh routine.

Figure 8:
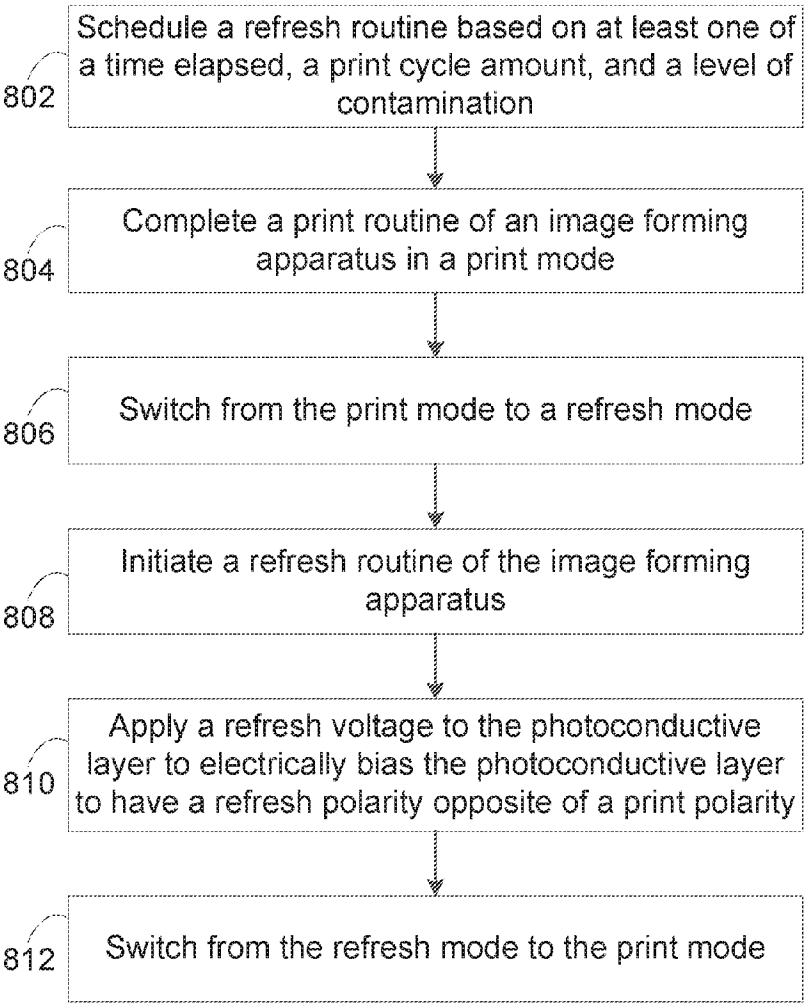
FIGS. 7 and 8 are flow diagrams depicting example methods for lessening a contamination effect.
Figure 7:
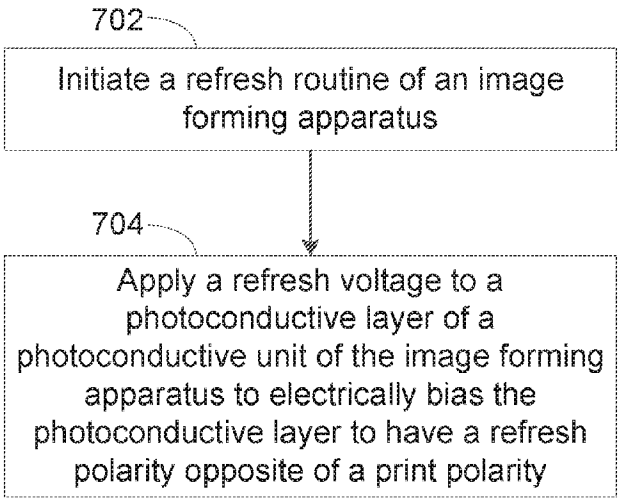

FIGS. 7 and 8 are flow diagrams depicting example methods for lessening a contamination. In discussing FIGS. 7 and 8, reference may be made to elements and diagrams of FIGS. 1-6 to provide contextual examples. Implementation, however, is not limited to those examples.

In block 702, a refresh routine of an image forming apparatus may be initiated. The image forming apparatus may include a photoconductive unit having a conductive layer and a photoconductive layer to apply a print material to a print article. Each one of the components of the image forming apparatus may be neutralized, powered off, or otherwise placed in an electrical state to allow the photoconductive layer to be charged during the refresh routine.

In block 704, a refresh voltage may be applied to the photoconductive layer to electrically bias the photoconductive layer to have a refresh polarity opposite of a print polarity. The refresh voltage may achieve an avalanche threshold.

The avalanche threshold may be determined based on an electric field strength and a gap length. The gap length may be between the photoconductive layer and the charge surface. The charge surface may be on a charge mechanism applying the refresh voltage to the photoconductive layer. The charge mechanism may be at least one of a refresh unit, the charge unit, and an intermediate unit. Another factor to determine the avalanche threshold may be the pressure of the gas in the area of the gap length.

Referring to FIG. 8, the discussion and description of blocks 702 and 704 may be applied to blocks 808 and 810 respectively.

In block 802, a refresh routine may be scheduled based on at least one of a time elapsed, a print cycle amount, and a level of contamination. The firmware module may schedule the refresh routine.

The image forming apparatus may be operable in a print mode and in a refresh mode. The refresh routine may be scheduled by manually selecting a refresh mode of the image forming apparatus or by dynamically selecting the refresh mode using a function based on at least one of a time elapsed, a print cycle amount, and a level of contamination.

In block 804, a print routine of the image forming apparatus may be completed while in a print mode. The firmware module may wait for any current print cycles to complete before performing a refresh routine or may interrupt the print routine to allow the refresh routine to execute.

In block 806, the image forming apparatus may switch from a print mode to a refresh mode. The firmware module may restrict enablement of the refresh mode for non-print routines. For example, the refresh mode may be available during a time period that no print cycles are being executed, or a non-print time in the print cycle, such as a pause in the print routine.

In block 808, the firmware module may initiate a refresh routine while in the refresh mode.

In block 810, a refresh voltage may be applied to the photoconductive layer to electrically bias the photoconductive layer to have a refresh polarity opposite of the print polarity. For example, the print polarity may be negative and the refresh polarity may be positive. The refresh voltage may be applied from the intermediate unit, multiple intermediate units, or a combination of the charge unit and one or more intermediate units. The one or more intermediate units may be charged to provide the refresh voltage. The combination voltage may achieve the avalanche threshold. The combination voltage may be one voltage from a single unit to apply the entire refresh voltage or the aggregate of voltages from multiple units. The refresh routine may apply the refresh voltage for a predetermined and/or calculated amount of time.

In block 812, the image forming apparatus may switch from the refresh mode to the print mode. For example, once the refresh routine is completed, the image forming apparatus may prepare for a print routine by completing all functions associated with the refresh routine and switch to a print mode.

Although the flow diagrams of FIGS. 7 and 8 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present invention.

The present description has been shown and described with reference to the foregoing exemplary embodiments. It is understood, however, that other forms, details, and embodiments may be made without departing from the spirit and scope of the invention that is defined in the following claims.

What is claimed is:

1. An image forming apparatus comprising:

a photoconductive unit including a photoconductive layer, the photoconductive layer electrically biased to have a first polarity during a print routine; and a refresh unit to apply a refresh voltage to the photoconductive layer during a refresh routine, the refresh unit including a charge unit to apply a first voltage to the photoconductive layer during the refresh routine and an intermediate unit to apply a second voltage to the photoconductive layer during the refresh routine, wherein a combination of the first and second voltages forms the refresh voltage to electrically bias the photoconductive layer to have a second polarity during the refresh routine, the refresh voltage to achieve an avalanche threshold and the second polarity to be opposite of the first polarity.

2. The image forming apparatus of claim 1, wherein the intermediate unit includes an offset unit to apply an offset voltage to a conductive layer of the photoconductive unit.

3. The image forming apparatus of claim 1, further comprising a firmware module in communication with the refresh unit, the firmware module to schedule the refresh routine, set a time period to execute the refresh routine, and set a level of the voltage applied by the refresh unit.

4. The image forming apparatus of claim 1, wherein the first polarity is negative, the second polarity is positive, and the refresh routine is a non-print routine.

5. An image forming apparatus comprising:

a photoconductive unit including a photoconductive layer;

a charge unit coupled to the photoconductive unit to apply a print voltage to the photoconductive layer to charge the photoconductive layer to a first polarity during a print routine; and a refresh unit coupled to the photoconductive unit to apply a refresh voltage to the photoconductive layer to charge the photoconductive layer to a second polarity during a refresh routine, the second polarity opposite of the first polarity and the refresh voltage to achieve an avalanche threshold, wherein during the refresh routine, the charge unit is to apply a first voltage to the photoconductive layer and the refresh unit is to apply a second voltage to the photoconductive layer, a combination of the first voltage and the second voltage forms the refresh voltage to charge the photoconductive layer to the second polarity.

6. The image forming apparatus of claim 5, wherein the refresh unit includes the charge unit, an offset unit, a development unit, a sponge unit, and a conductive layer of the photoconductive unit and the refresh voltage is a combination of voltages from the at least one of the charge unit, the offset unit, the development unit, the sponge unit, and the conductive layer of the photoconductive unit.

7. The image forming apparatus of claim 6, comprising the offset unit coupled to the photoconductive unit to charge the photoconductive layer with an offset unit voltage during the refresh routine.

8. The image forming apparatus of claim 7, wherein the combination of the first voltage from the charge unit and the offset unit voltage from the offset unit achieves the avalanche threshold.

9. A method for lessening a contamination effect comprising:

initiating a refresh routine of an image forming apparatus, the image forming apparatus including a photoconductive unit having a photoconductive layer; and applying a combination of a first voltage from a charge unit and a second voltage from an intermediate unit to the photoconductive layer during the refresh routine, wherein the combination of the first and second voltages forms a refresh voltage to electrically bias the photoconductive layer to have a refresh polarity opposite of a print polarity, the refresh voltage to achieve an avalanche threshold.

10. The method of claim 9, wherein the avalanche threshold is determined based on an electric field strength and a gap length between the photoconductive layer and the charge surface of a charge mechanism, the charge mechanism to apply the refresh voltage to the photoconductive layer.

11. The method of claim 10, wherein the charge mechanism includes the charge unit and the intermediate unit.

12. The method of claim 11, further comprising, during a print routine, charging the intermediate unit by the charge unit.

13. The method of claim 9, further comprising scheduling the refresh routine based on at least one of a time elapsed, a print cycle amount, and a level of contamination.

14. The method of claim 9, further comprising:

completing a print routine of the image forming apparatus in a print mode, the image forming apparatus operable in the print mode and a refresh mode; and switching from the print mode to the refresh mode.

* * * * *